US005551274A

United States Patent [19]

Hintz

[11] Patent Number: 5,551,274

[45] Date of Patent: Sep. 3, 1996

[54] IMPACT ABSORPTION FOR STAMPING PRESS

[75] Inventor: Howard Hintz, Bridgeview, Ill.

[73] Assignee: Clearing Niagara, Inc., Chicago, Ill.

[21] Appl. No.: 343,085

[22] Filed: Nov. 21, 1994

[51] Int. Cl.[6] ..... B21J 7/12

[52] U.S. Cl. ..... 72/431; 72/453.14

[58] Field of Search ..... 72/453.09, 453.14, 72/431

[56] References Cited

U.S. PATENT DOCUMENTS

| | | | |
|---|---|---|---|
| 2,393,771 | 1/1946 | Heintz | 72/431 |
| 3,417,599 | 12/1968 | Burns | 72/431 |
| 4,610,156 | 9/1986 | Kaminshi et al. | 72/431 |
| 4,890,476 | 1/1990 | Takahashi et al. | 72/453.09 |
| 5,078,003 | 1/1992 | Oishi | 72/453.13 |

FOREIGN PATENT DOCUMENTS

| | | | |
|---|---|---|---|
| 226682 | 4/1909 | Germany | 72/431 |
| 625831 | 9/1978 | U.S.S.R. | 72/431 |

*Primary Examiner*—David Jones
*Attorney, Agent, or Firm*—Emrich & Dithmar

[57] ABSTRACT

In a stamping press, an outer slide lowers an upper holding ring toward a lower holding ring for pinching the edge of a piece part for maintaining the piece part in fixed position between a lower die and a moveable upper die. Further downward displacement of the upper holding ring also moves the lower holding ring downward, stretching the piece part over the lower die. Striking of a lower die support by the lower holding ring is cushioned by gas-filled cylinders. With the stretched piece part maintained in fixed position on the lower die by the upper and lower holding rings, an inner slide then lowers the upper die toward the lower die for stamping the piece part. A drive mechanism lowers the outer and inner slides via respective pluralities of pull rods coupled to the slides. With the upper holding ring traveling at high speed at mid-stroke when it strikes the lower holding ring, a large instantaneous and momentary impact force is experienced which causes damage to press components over time. An impact absorber is attached to each of the pull rods coupled to the outer slide (and may also be connected to the pull rods coupled to the inner slide) to absorb the high impact force and cushion striking of the lower holding ring by the upper holding ring. Each impact absorber includes one or more stacked disc springs disposed about a respective pull rod for deflecting the high impact force and isolating the pull rod and associated linkage from this force.

12 Claims, 7 Drawing Sheets

IMPACT ABSORPTION FOR STAMPING PRESS

FIELD OF THE INVENTION

This invention relates generally to metal stamping presses and is particularly directed to the absorption of high impact forces arising from high speed striking of moving press components for reducing excessive wear and damage to components in the press.

BACKGROUND OF THE INVENTION

Sheet metal piece parts such as used in automobiles, appliances, aircraft, farm implements, construction equipment, etc., are typically formed by a series of stamping operations in a multi-stage mechanical transfer press which manipulates the workpiece to a desired shape and size. Each stamping operation makes use of a pair of dies which engage the sheet metal piece part and form it as desired.

A process known as stretch forming has been gaining increasing acceptance in shaping and sizing of sheet metal piece parts. In this approach, the piece part is engaged around its peripheral edge by upper and lower holding rings which maintain the piece part in fixed position while stretching it on a fixed lower die. A movable upper die then stamps the piece part in the desired size and shape. A primary advantage of this stretch forming approach are a reduction in piece part size and an associated cost savings. Another advantage of this approach is in a more uniform stretching of the piece part over its entire surface rather than greater stretching in the corners of the piece part in comparison with its inner portion as in prior art approaches. The more uniform stretching of the piece part reduces so-called "loose metal", or "flutter". As a result, the stretch forming technique provides higher quality parts with more consistent and predictable properties.

Prior art stretch forming approaches to metal piece part stamping are not without limitations. One problem encountered in the prior art arises from the high impact force between the moving upper holding ring and the lower holding ring in pinching the outer peripheral edge of the piece part. At this stage in the stamping process, the upper holding ring is in mid-stroke and traveling at high speed giving rise to excessively high impact forces which frequently are well beyond the rated tonnage capacity of the press resulting in excessive wear and damage to the press necessitating costly and time consuming repair.

This invention addresses the aforementioned limitations of the prior art by providing for high impact force absorption in a stamping press for isolating press components from these impact forces which may exceed the rated tonnage capacity of the press and cause damage to or destruction of press components.

OBJECTS AND SUMMARY OF THE INVENTION

Accordingly, it is an object of the present invention to absorb and dissipate high impact forces in a stamping press.

It is another object of the present invention to provide an impact absorption arrangement for isolating components such as eccentric gears, links, and associated parts in a stamping press from high impact forces between moving components of the press.

Yet another object of the present invention is to facilitate retrofit of existing stamping presses to accommodate impact forces which may exceed the rated tonnage of the press without redesigning the press or employing expensive replacement components.

This invention contemplates a stamping press wherein a piece part is engaged by first and second die members for forming the piece part into a desired configuration and size, wherein the first die member contacts the second die member giving rise to a high impact force, the stamping press comprising: a die support member coupled to and providing support for the first die member; a drive mechanism undergoing reciprocating, linear displacement; linkage connecting the die support member to the drive mechanism for displacing said die support member and the first die member in a reciprocating, linear manner, wherein the first die member contacts the second die member; and resilient impact absorption means coupled to the linkage for absorbing and isolating the linkage from the high impact force.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
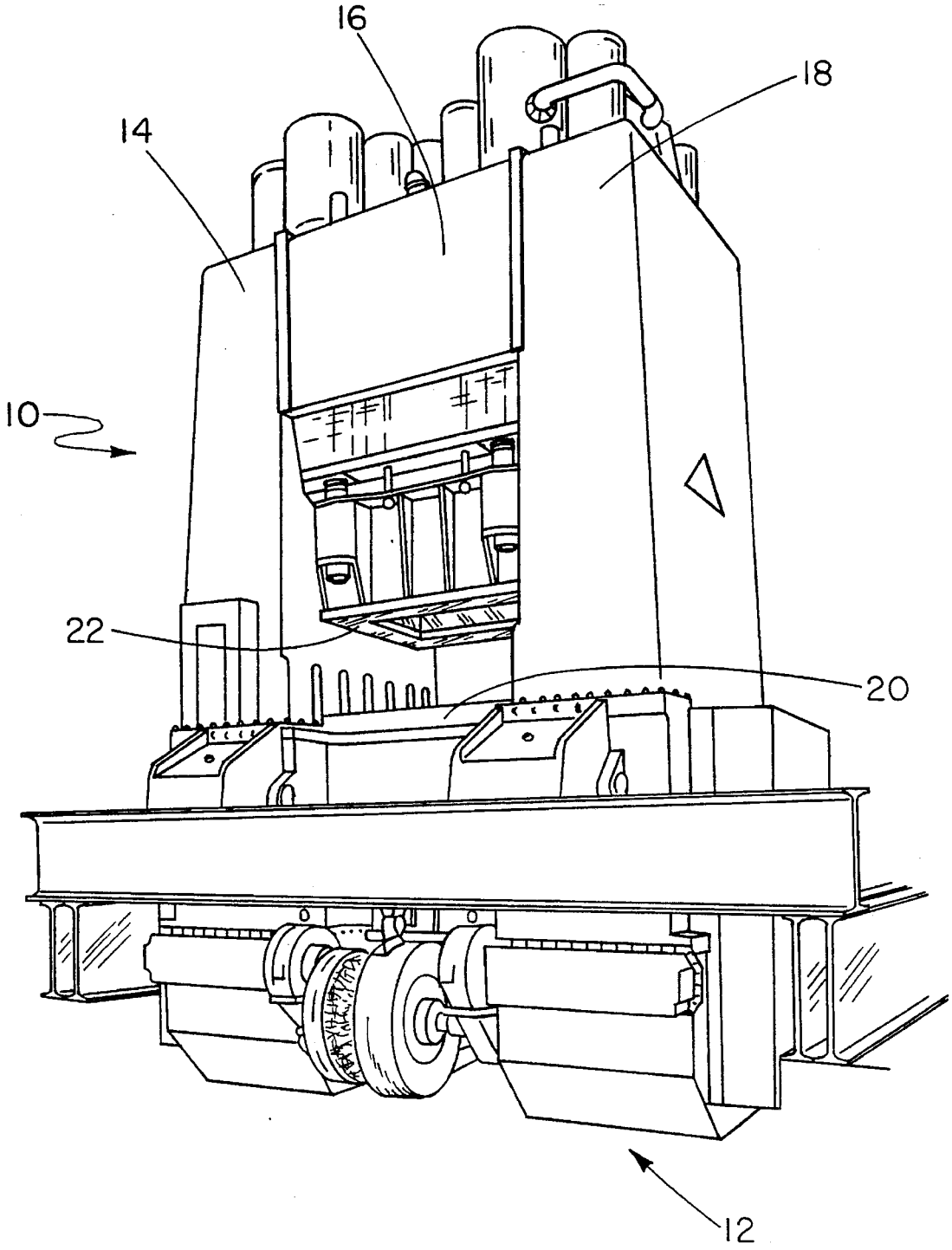
FIG. 1 is a perspective view of a double action, bottom drive stamping press which is one type of press in which the impact absorption arrangement of the present invention is intended for use.

Referring to FIG. 1, there is shown a perspective view of a bottom drive stamping press 10 in which the impact absorption arrangement of the present invention is adapted for use. Stamping press 10 includes a lower housing with a drive mechanism 12, first and second generally upright columns 14 and 18, and an upper housing 16. The drive mechanism 12 located in the lower housing is coupled to various drive components located in the columns 14 and 18 as well as in the upper housing 16 which are not shown in the figure for simplicity. The first and second upright columns 14, 18 are arranged in a spaced manner with the upper housing 16 disposed therebetween. Suspended from the upper housing and also disposed intermediate the first and second columns 14, 18 is an outer slide 22 and an inner slide (not shown). The outer and inner slides are adapted for vertical displacement as described in detail below for moving an upper holding ring and an upper die (also not shown in the figure for simplicity) for engaging and working a piece part in combination with a fixed lower die. The lower die is mounted to and supported by a bolster plate 20 disposed on an upper portion of the lower housing above the drive mechanism 12. Each piece part, or blank, is sequentially moved into position between the upper and lower dies and is removed therefrom after being engaged by the dies and appropriately reconfigured and shaped.

Figure 2A:
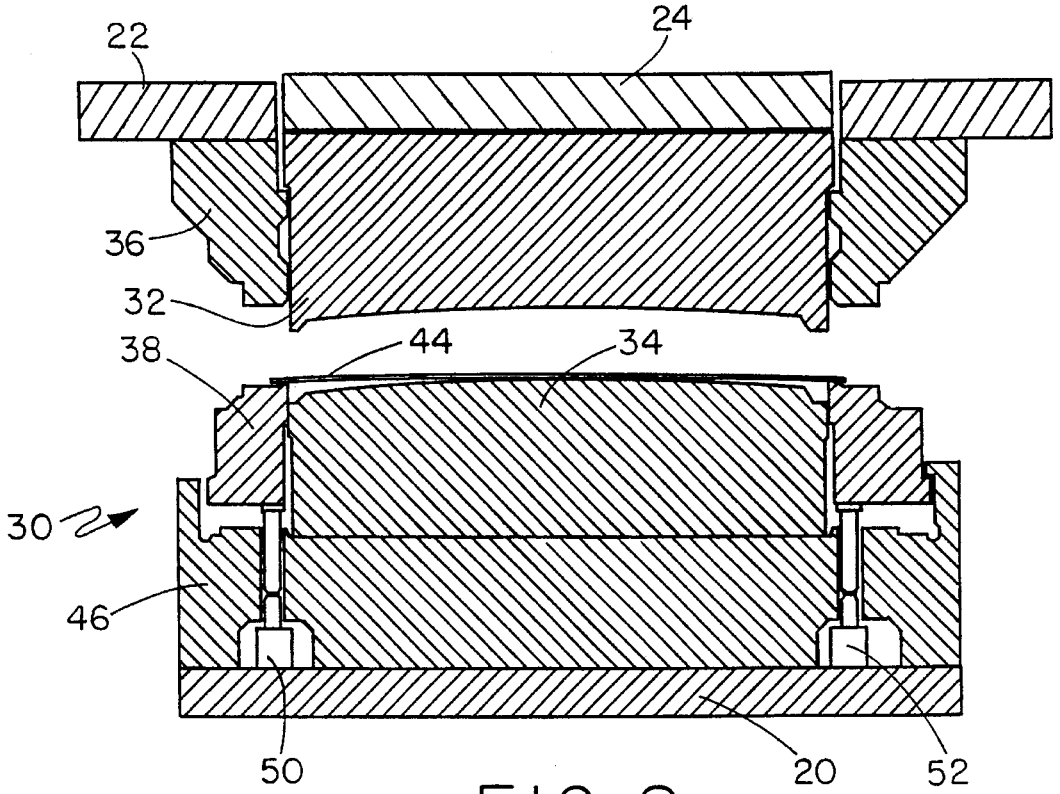
FIGS. 2*a–d* are sectional views of an upper and lower die and upper and lower holding ring arrangement such as in a double action stamping press illustrating the sequence of operations in forming a piece part in a given shape and configuration.

Referring to FIGS. 2*a–d*, there is shown a series of sectional views illustrating the sequence of events carried out by various components in the stamping press 10 of FIG. 1 in manipulating a piece part 44 to a desired shape and size. In these and other figures discussed below the same element shown in the various figures and described herein retains the same identifying number throughout the description. The sequence starts as shown in FIG. 2*a* with an outer slide 22 and an inner slide 24 in the fully upraised position. Attached to and suspended from the outer slide 22 is an upper holding ring 36. Similarly, attached to and suspended from the inner slide 24 is an upper die 32. Outer slide 22 and inner slide 24 are coupled to respective drive arrangements for drawing each of the slides downward in a generally vertical direction as described below.

Disposed below the combination of the upper die 32 and upper holding ring 36 is a lower die 34 and a lower holding ring 38. A sheet metal piece part 44 is positioned on the lower die 34 and lower holding ring 38 prior to the stamping operation. As shown in FIG. 2*a*, the lower surface of upper die 32 and the upper surface of lower die 34 are contoured to provide the piece part 44 with a desired shape and configuration. Lower die 34 is disposed upon and supported by a lower die support 46 which, in turn, is positioned upon and supported by bolster plate 20. The combination of the bolster plate 20, lower die support 46, and lower die 34 is maintained in fixed position within the stamping press by various support members which are conventional in design, do not form a part of the present invention, and are thus not shown in the figures.

Figure 2B:
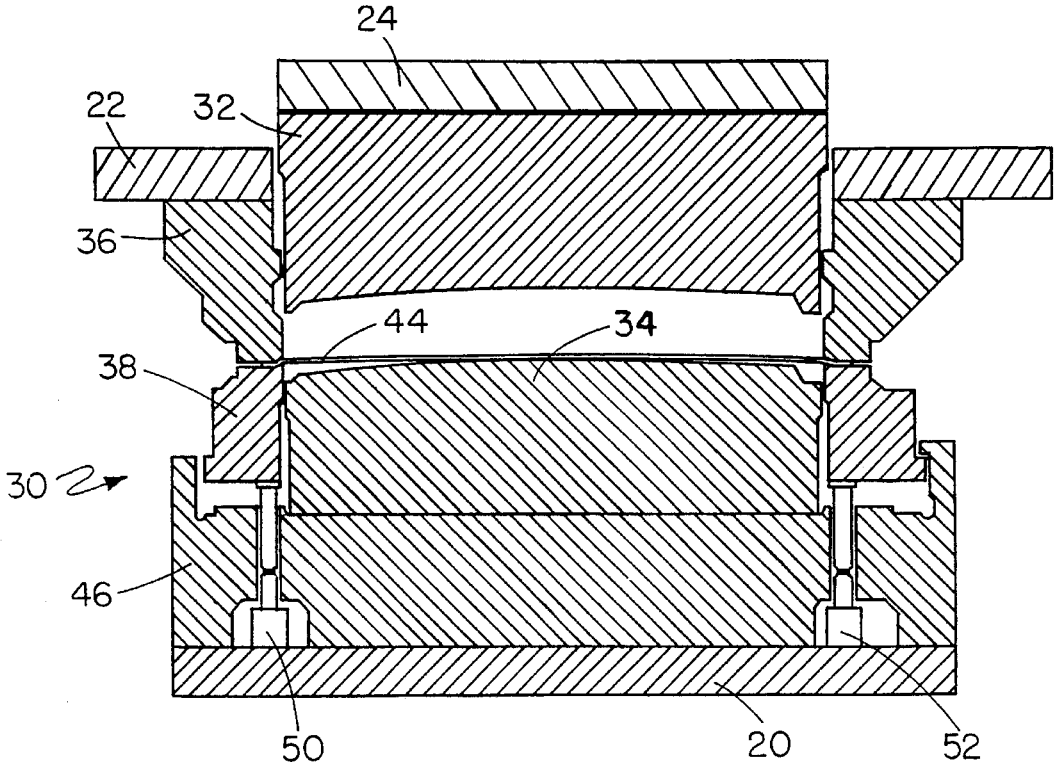

The first step in the stretch drawing process is shown in the sectional view of FIG. 2*b*, where the outer slide 22 has lowered the upper holding ring 36 into secure engagement with a peripheral edge of the piece part 44. The peripheral edge of piece part 44 is thus pinched between the upper and lower holding rings 36, 38 for maintaining the piece part in fixed position and intimate contact with the upper surface of lower die 34.

Figure 2C:
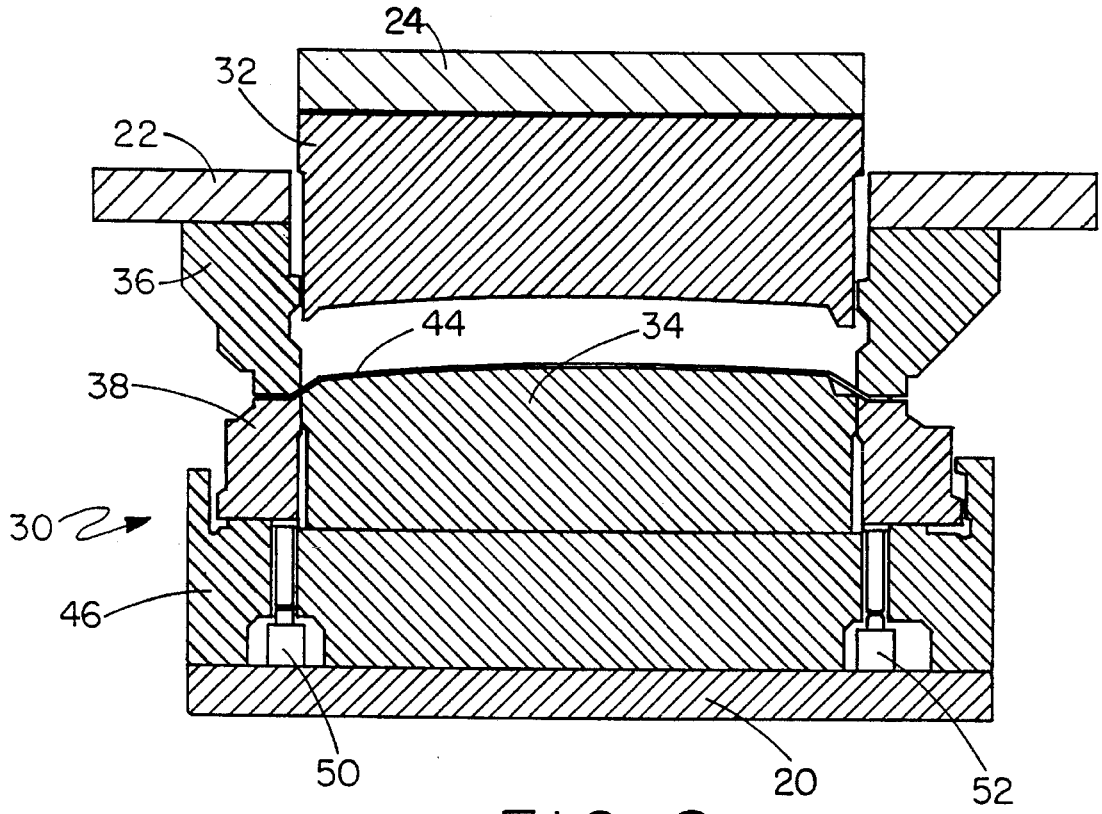

With the upper and lower holding rings 36, 38 engaging the peripheral edge of piece part 44, outer slide 22 further lowers the upper holding ring and the lower holding ring as shown in FIG. 2*c*. Downward displacement of the upper and lower holding rings 36, 38 continues until the lower holding ring contacts an upper surface of lower die holder 46 as shown in FIG. 2*c*. A plurality of gas cylinders 50, 52 (only two of which are shown in the sectional views of FIGS. 2*a–d*) cushion the downward displacement of the two holding rings 36, 38. As the upper and lower holding rings 36, 38 engaging the peripheral edge of piece part 44 are lowered downward toward the lower die support 46, piece part 44 is not only maintained in fixed, intimate contact with the upper surface of lower die 34, but is also stretched over the upper surface of the lower die. With lower holding ring 38 in contact with an upper surface of lower die support 46, gas cylinders 50 and 52 are fully compressed and bottom out. The vertical displacement of the lower holding ring 38 between the fully upraised position as shown in FIG. 2*a* and the fully lowered position is shown in FIG. 2*c* is typically on the order of 3"–4".

Figure 2D:
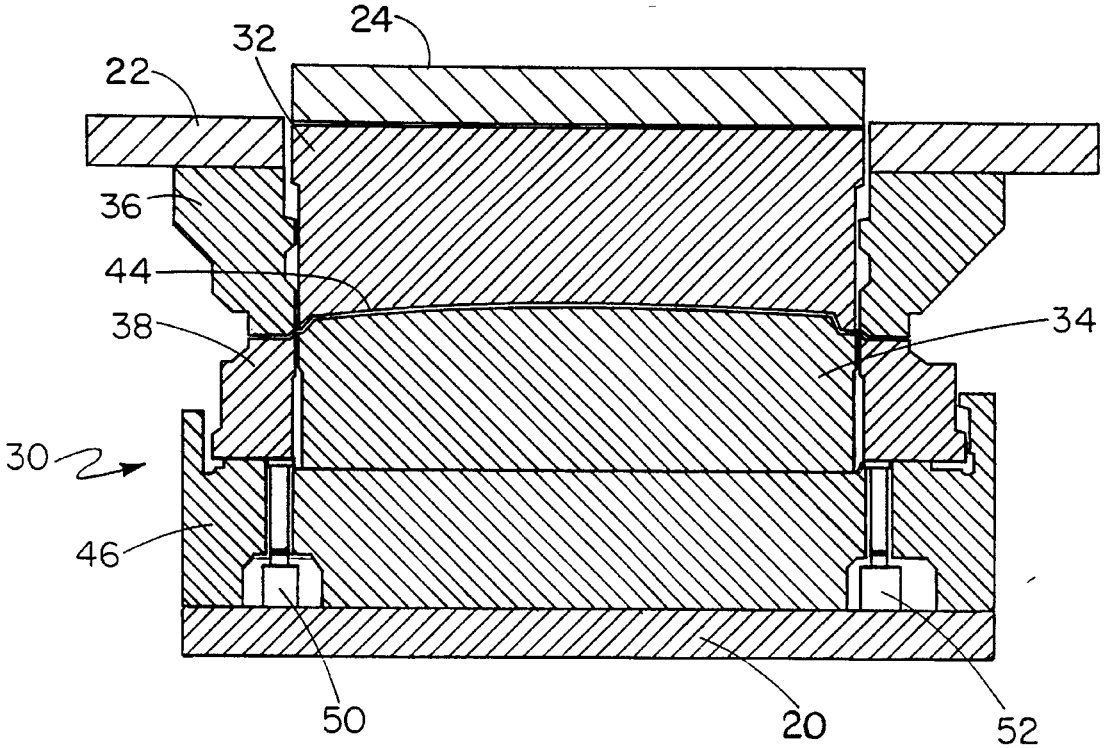

Referring to FIG. 2*d*, the last step in the stamping process is shown. In the last step, inner slide 24 lowers upper die 32 to a position in intimate contact with piece part 44 on the lower die 34 so as to reconfigure and reshape the piece part as shown in the figure. After piece part 44 is stamped, the upper holding ring 36 is then drawn upward by means of the outer slide 22 and the lower holding ring 38 is urged to its uppermost position by gas cylinders 50, 52 to the position shown in FIG. 2*a*. The stamping cycle is then reinitiated for carrying out the sequence of events shown in FIGS. 2*b*, 2*c* and 2*d* on another piece part.

It is at the step in the stamping process illustrated in FIG. 2*b* that the problem which the present invention is intended to overcome occurs. In FIG. 2*b* as described above, the upper holding ring 36 is lowered at high speed to a position at mid-stroke where it engages piece part 44 and contacts the upper surface of the lower holding ring 38 through the piece part. The high speed of and large forces exerted on the upper holding ring 36 result in a large instantaneous momentary impact force on the lower holding ring 38. This impact force may substantially exceed the rated tonnage capacity of the stamping press causing damage to the drive mechanism and associated linkage which displaces the outer slide 22 and upper holding ring 36 combination.

Figure 3:
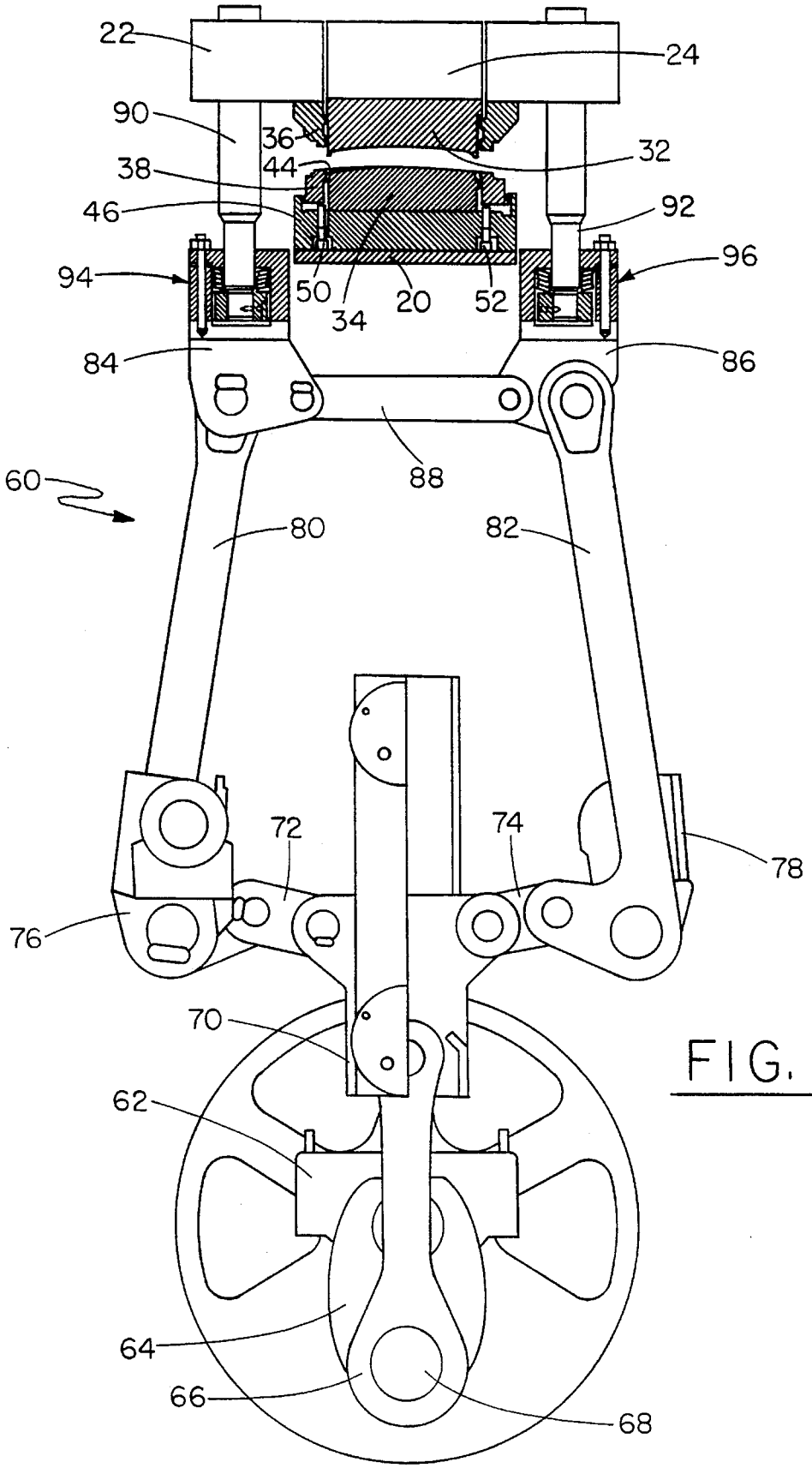
FIG. 3 is a simplified end view of a portion of the drive linkage employed in a bottom drive stamping press in which the impact absorbing arrangement of the present invention is intended for use.

Referring to FIG. 3, there is shown blankholder linkage 60 for raising and lowering the outer slide 22 and upper holding ring 36 combination which incorporates first and second impact absorbers 94 and 96 in accordance with the present invention. Blankholder linkage 60 includes a reciprocally driven drive arm 66 coupled at one end by means of a retainer 68 to a rotating arm 64. A second end of drive arm 66 is pivotally coupled to a blankholder crosshead 70 which, in turn, is coupled to first and second rocker links 76 and 78 by means of first and second rocker arms 72 and 74, respectively. First rocker link 76 is coupled by means of a first blankholder connecting arm 80 to a first clevis 84, while the second rocker link 78 is coupled by means of a second blankholder connecting arm 82 to a second clevis 86. Pivotally coupled at respective ends thereof to the first and second clevises 84, 86 is a crossbar 88.

In accordance with the present invention, attached to respective upper portions of the first and second clevises 84, 86 are the first and second impact absorbers 94 and 96 which are described in detail below. Coupled to and extending upward from the first and second impact absorbers 94, 96 are first and second pull rods 90 and 92, respectively. Upper ends of the first and second pull rods 90, 92 are attached to outer slide 22 for raising and lowering the outer slide as well as the upper holding ring 36 attached thereto. The stretch draw press mechanism 30 shown in the upper portion of FIG. 3 is identical in configuration and operation to that shown in FIGS. 2*a–d* and described above. Rotational displacement of rotating arm 64 causes reciprocating displacement of outer slide 22 and upper holding ring 36 as described above and as illustrated in FIGS. 2*a–d*.

Figure 5:
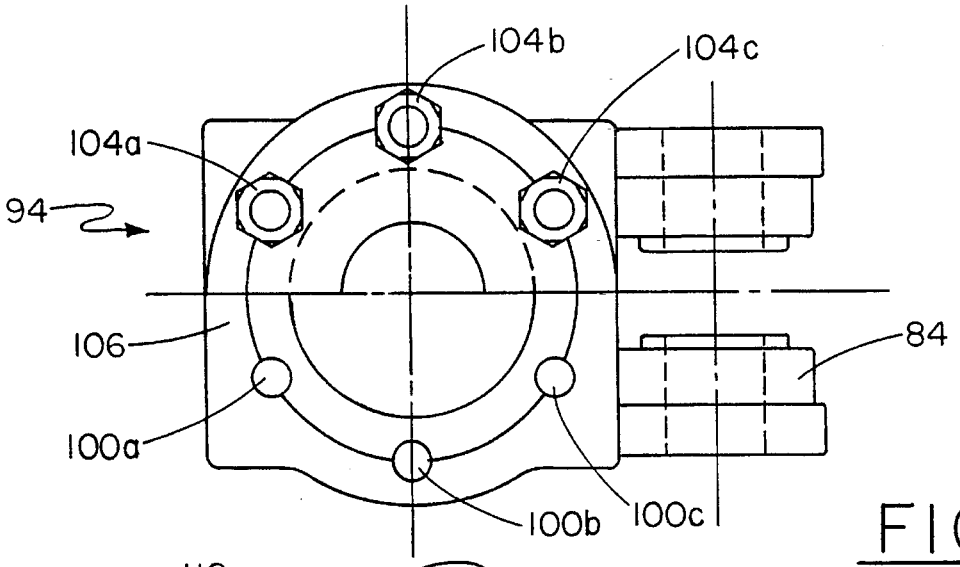
FIG. 5 is a top plan view of the impact absorption arrangement of FIG. 4.
Figure 4:
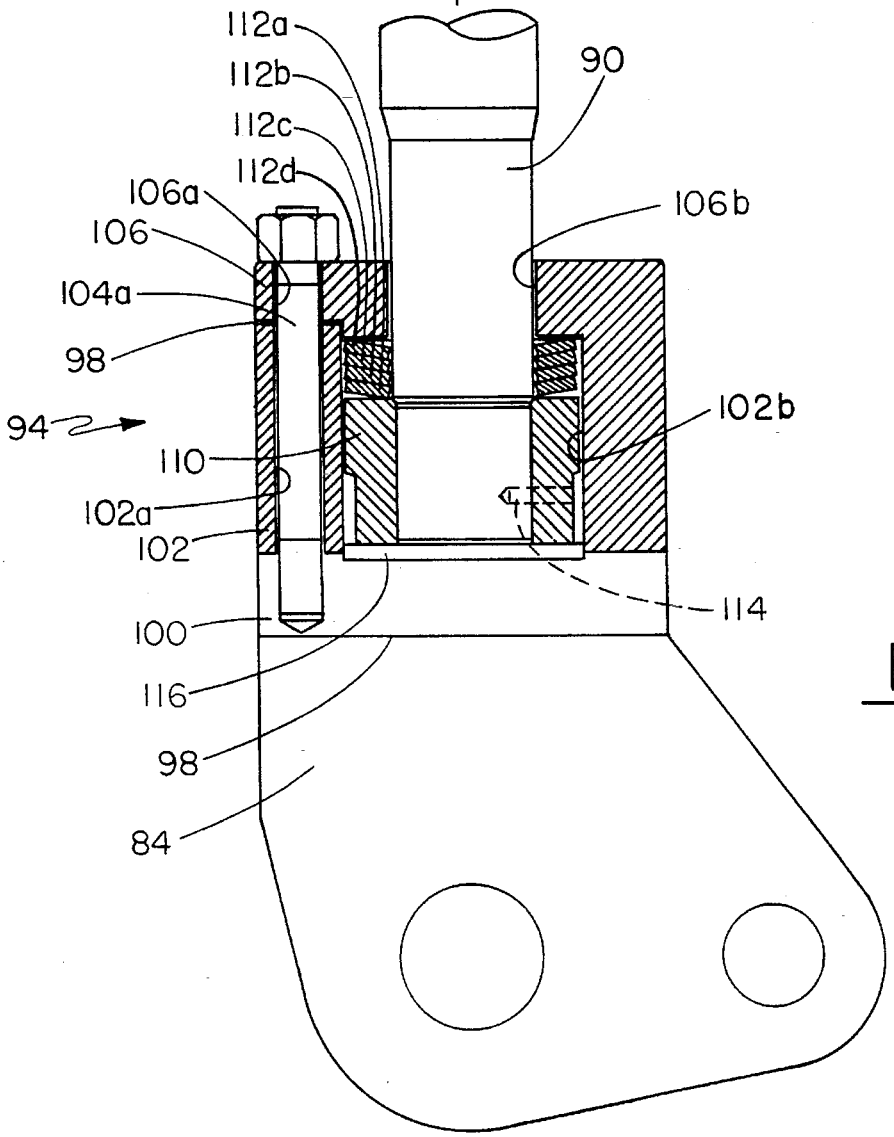
FIG. 4 is a partially cutaway lateral view of the impact absorption arrangement of the present invention incorporated in the drive linkage of a stamping press.

Referring to FIG. 4, there is shown a partially cutaway view of the first impact absorber 94 mounted to clevis 84 and further attached to pull rod 90. FIG. 5 is a partially cutaway top plan view of the impact absorber 94 of FIG. 4. Impact absorber 94 is attached to and formed integrally with clevis 84 by means of a weldment 98. Impact absorber 94 includes a lower coupling plate 100 which is directly mounted to clevis 84 by means of the aforementioned weldment 98. Coupling plate 100 includes a plurality of spaced, threaded slots disposed about an outer portion of the plate, three of which are shown in FIG. 5 as elements 100*a*, 100*b* and 100*c*. Impact absorber 94 also includes an annular housing 102 with a plurality of drilled slots 102*a* therein. Impact absorber 94 also includes an upper annular cap 106 having a plurality of outer peripheral apertures 106*a* and a center aperture 106*b* through which the lower end of pull rod 90 extends. As shown in the top view of the impact absorber 94 of FIG. 5, a plurality of spaced bolts (three of which are identified as elements 104*a*, 104*b* and 104*c*) are inserted through respective, aligned apertures in the impact absorber's upper cap 106, intermediate annular housing 102, and lower coupling plate 100. Each of these bolts engages the threaded portion within a respective slot 100*a* within coupling plate 100 for securely connecting coupling plate 100, annular housing 102 and cap 106.

The lower end of pull rod 90 is inserted through center apertures 106*b* and 102*b* respectively in the upper cap 106 and intermediate annular housing 102. The lower end of pull rod 90 is positioned in contact with a hardened steel plate 116 disposed on an upper, center portion of coupling plate 100. Disposed about the lower end of pull rod 90 and within the center aperture 102*b* of annular housing 102 is a loose nut 110. Nut 110 is attached to the lower end of pull rod 90 by means of a bolt or dowel 114 (shown in dotted line form) for also attaching the pull rod to the impact absorber 94.

Figure 6:
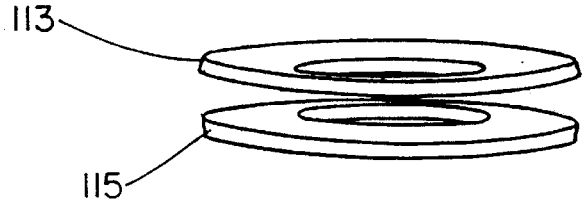
FIG. 6 is a perspective view of a pair of disc springs employed in the impact absorption arrangement of the present invention.
Figure 7:
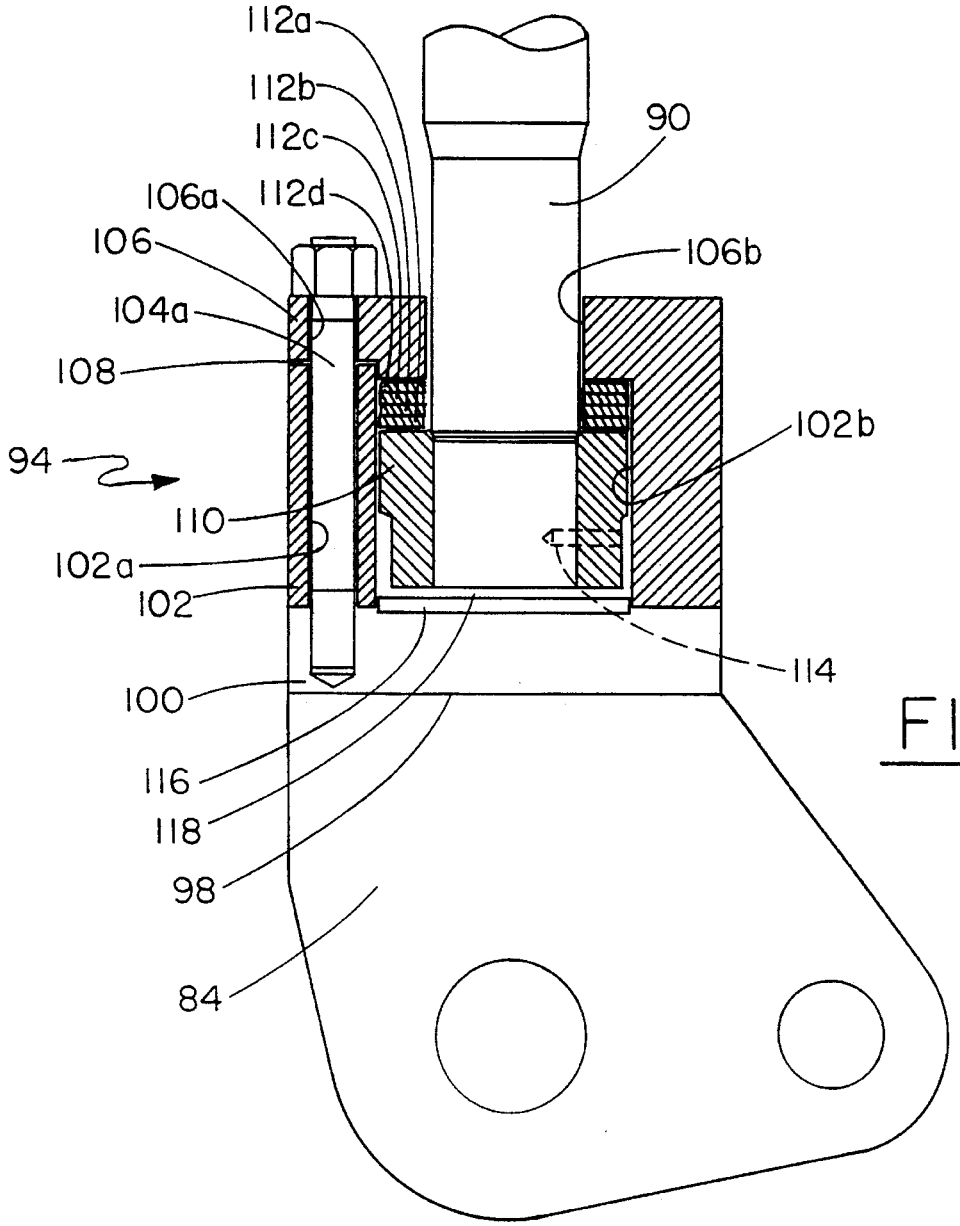
FIG. 7 is a partially cutaway lateral view of the impact absorption arrangement shown in FIG. 4 illustrating the impact absorption arrangement in the fully compressed configuration during impact force absorption.

Disposed about the lower portion of the pull rod 90 and intermediate nut 110 and upper cap 106 are a plurality of annular disc springs 112*a–d* . Each of the disc springs 112*a–d* is comprised of a high strength, resilient steel and is beveled inwardly as shown in the sectional view of FIG. 4 and the perspective view of two such disc springs 113 and 115 of FIG. 6. The disc springs 112*a–d* shown in FIG. 4 are in an unloaded configuration and thus retain their beveled shape. When a load is applied to the disc springs 112*a–d* such as with the relative displacement between pull rod 90 and impact absorber 94, the disc springs 112*a–d* undergo a reconfiguration toward a flattened shape as shown in the partial sectional view of FIG. 7. FIG. 7 is similar to FIG. 4 except that the impact absorber 94 is shown during absorption of a high impact force in FIG. 7. The disc springs 112*a–d* thus serve to absorb large impact forces which cause relative displacement between pull rod 90 and the combination of clevis 84 and impact absorber 94. Relative displacement between pull rod 90 and the combination of clevis 84 and impact absorber 94 occurs when the upper holding ring 36 contacts the lower holding ring 38 as described above and shown in FIG. 2*b* . The high impact force arising from contact between the upper holding ring 36 and lower holding ring 38 is absorbed by deflection, or flattening, of the disc springs 112*a–d* disposed about pull rod 90 and intermediate the impact absorber's upper cap 106 and inner nut 110. During absorption of a high impact force a gap 118 develops between the end of pull rod 90 and the steel plate 116 because of the compression, or deflection, of the disc springs. Although four (4) disc springs 112*a–d* are shown in the figures, the impact absorber 94 of the present invention is not limited to this arrangement, but may use virtually any number of disc springs depending upon the magnitude of the anticipated impact force. Shims 98 may be inserted between the annular housing 102 and upper cap 106 about each of the bolts to ensure proper alignment between the pull rod 90 and impact absorber 94.

Figure 8:
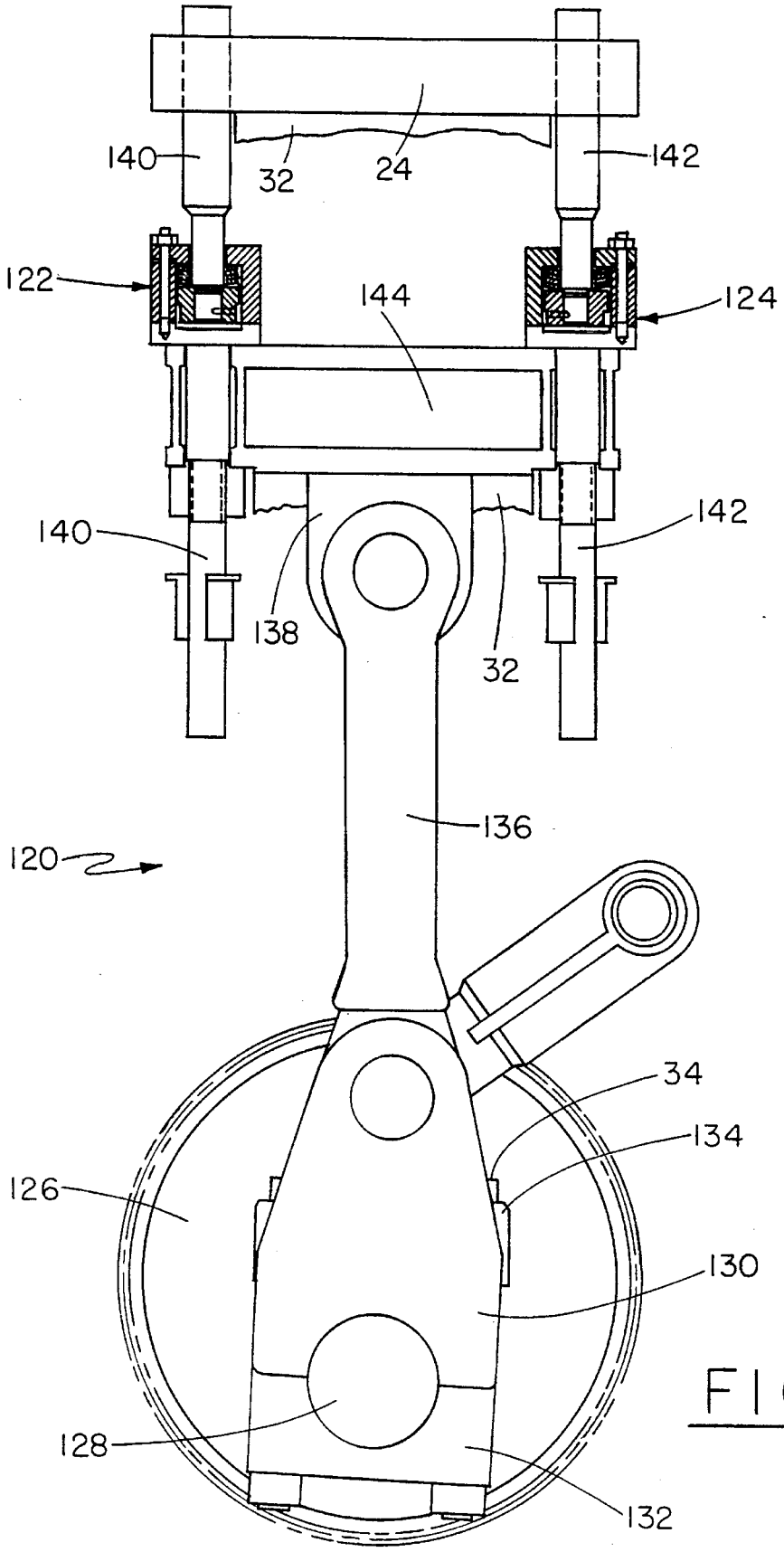
FIG. 8 is a simplified end view of a portion of the drive linkage and connections for an inner slide and movable upper die combination in a stamping press incorporating an impact absorption arrangement in accordance with another embodiment of the present invention.

Referring to FIG. 8, there is shown a simplified side view of an inner slide drive arrangement 120 for vertically displacing inner slide 24 and upper die 32. The inner slide drive mechanism 120 includes first and second impact absorbers 122 and 124 in accordance with another aspect of the present invention. Shown in FIG. 8 is a pillow block 134 upon which the fixed lower die and its support are positioned. The inner slide drive mechanism 120 further includes a drive wheel 126 coupled by means of a retainer 128 to the combination of an inner slide connection 130 and a connection cap 132. The upper end of inner slide connection 130 is pivotally coupled to the lower end of a connection link 136. The upper end of connection link 136 is pivotally coupled to a coupling bracket 138 connected to a lower portion of a crosshead 144.

Rotational displacement of drive wheel 126 results in reciprocating vertical displacement of connection link 136 and crosshead 144 coupled thereto. Inner slide 24 is coupled to crosshead 144 via first and second pull rods 140 and 142. As previously described, mounted to the lower surface of inner slide 24 is the upper die 32. There are typically four pull rods attached to the inner slide 24 adjacent respective corners thereof. Inner slide 24 is displaced vertically by the first and second pull rods 140, 142 as it undergoes vertical, reciprocating motion provided by the inner slide drive mechanism 120. Mounted to an upper surface of crosshead 144 and to respective lower ends of pull rods 140 and 142 are the first and second impact absorbers 122 and 124, with two additional impact absorbers provided for each of the other pull rods which are not shown in the figure. Impact absorbers 122 and 124 are identical in configuration and function to the impact absorbers described above and shown in FIGS. 3, 4 and 5. Impact absorbers 122 and 124 absorb high impact forces arising from contact of the upper die with the piece part supported on the lower die. Impact absorbers 122, 124 deflect the high impact force which may be greater than the rated tonnage capacity of the press in order to avoid damage to and the possible destruction of press components.

There has thus been shown an impact absorption arrangement for a stamping press which is capable of absorbing, and isolating press components from, impact forces well in excess of the rated tonnage capacity of the press without damage or destruction to the components. The impact absorption arrangement includes a plurality of impact absorbers each coupling a respective pull rod to a holding ring or other die support member for absorbing impact forces between adjacent holding rings or dies travelling at high speeds under large forces. The inventive impact absorber is adapted for retrofit in existing presses, employs readily available, conventional components, and is capable of absorbing very large impact forces which tend to damage and destroy press components if not isolated from the components.

While particular embodiments of the present invention have been shown and described, it will be obvious to those skilled in the art that changes and modifications may be made without departing from the invention in its broader aspects. For example, while the present impact absorption arrangement has been described in terms of its use in inner and outer slide drive arrangements, the inventive impact absorption arrangement may be employed in virtually any moving assembly of components in a stamping press where an elongated rod or shaft is displaced along its longitudinal axis and encounters a high impact force. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A stamping press wherein a piece part is engaged by first and second die members for forming said piece part into a desired configuration and size, wherein said first die member contacts said second die member giving rise to a high impact force, said stamping press comprising:

a die support member coupled to and providing support for said first die member;

a drive mechanism undergoing reciprocating, linear displacement;

linkage including a plurality of pull rods connecting said die support member to said drive mechanism for displacing said die support member and said first die member in a reciprocating, linear manner, wherein said first die member contacts said second die member and the high impact force is directed along the length of said pull rods; and resilient impact absorption means including one or more disc springs disposed about and coupled to an end of each of said pull rods and engaging adjacent movable linkage members for undergoing compression during absorption of an impact force and for assuming a non-compressed state when the impact force is removed in absorbing and isolating said linkage from the high impact force.

2. The stamping press of claim 1 wherein said adjacent movable linkage members include a first annular member coupled to said pull rod and a second annular member coupled via suitable linkage to said drive mechanism, and wherein said first and second annular members are disposed about said pull rod and are further disposed on respective sides and engage respective opposed portions of said one or more disc springs.

3. An impact absorber for use in a stamping press wherein a first die member contacts a second die member giving rise to a high impact force, and wherein a drive mechanism coupled to said first die member via a plurality of pull rods displaces said first die member in a linear, reciprocating manner, said impact absorber comprising:

an annular housing coupled at a first end thereof to said drive mechanism and including an inner aperture therein for receiving an end of a pull rod, said annular housing having a second opposed end with an outer aperture therein, wherein said pull rod extends through said outer aperture and into said inner aperture and wherein said outer aperture is smaller in diameter than said inner aperture;

retaining means coupled to an end of said pull rod and disposed in the inner aperture of said annular housing for preventing withdrawal of said pull rod from said annular housing; and compressible, resilient means disposed about said pull rod adjacent said retaining means and within the inner aperture of said housing, wherein said compressible, resilient means is disposed intermediate said retaining means and the second end of said housing for absorbing a force tending to withdraw the pull rod from said housing and for urging the pull rod to a fully inserted position within said housing, wherein a distal end of the pull rod engages an inner wall of said housing forming a portion of the first end thereof.

4. The impact absorber of claim 3 wherein said compressible, resilient means includes one or more disc springs disposed about and arranged in a stacked array along a portion of the length of said pull rod.

5. The impact absorber of claim 4 wherein said one or more disc springs each has a beveled configuration when not compressed and assumes a generally flat configuration when compressed between said retaining means and the second end of said housing.

6. The impact absorber of claim 5 wherein said retaining means includes a nut.

7. The impact absorber of claim 6 further comprising a bolt connecting said nut to the end of said pull rod.

8. The impact absorber of claim 4 wherein said annular housing includes a cap forming the first end thereof and including said outer aperture.

9. The impact absorber of claim 8 further comprising coupling means for attaching said cap to said annular housing.

10. The impact absorber of claim 9 wherein said coupling means includes a plurality of bolts.

11. The impact absorber of claim 3 wherein said drive mechanism includes a clevis and wherein the first end of said annular housing is attached to said clevis by means of a weldment.

12. The impact absorber of claim 3 further comprising a steel plate disposed on the inner wall of said annular housing for engaging the distal end of said pull rod.

* * * * *